US005941418A

United States Patent [19]

Box et al.

[11] Patent Number: 5,941,418

[45] Date of Patent: Aug. 24, 1999

[54] MULTIPLE FLUID DISPENSING SYSTEM

[75] Inventors: Gary W. Box, Golden Valley; Neal A. Werner, Bloomington, both of Minn.

[73] Assignee: Graco Inc, Minneapolis, Minn.

[21] Appl. No.: 08/769,246

[22] Filed: Dec. 18, 1996

Related U.S. Application Data

[60] Provisional application No. 60/009,301, Dec. 29, 1995.

[51] Int. Cl.[6] ..... B67D 5/16

[52] U.S. Cl. ..... 222/71; 222/75; 222/135; 222/255

[58] Field of Search ..... 222/63, 71, 74, 222/75, 135, 255

[56] References Cited

U.S. PATENT DOCUMENTS

| | | | |
|---|---|---|---|
| 4,978,029 | 12/1990 | Furrow et al. | 222/135 |
| 5,018,645 | 5/1991 | Zinsmeyer | 222/71 |
| 5,029,100 | 7/1991 | Young et al. | 222/75 |
| 5,139,045 | 8/1992 | Ensign | 222/71 |
| 5,257,720 | 11/1993 | Wulc et al. | 222/71 |
| 5,651,478 | 7/1997 | Tatsuno | 222/135 |

*Primary Examiner*—Joseph A. Kaufman
*Attorney, Agent, or Firm*—Douglas B. Farrow

[57] ABSTRACT

A device for dispensing multiple fluids in, for instance, a vehicle service facility is provided with a plurality of control modules. Each of those modules is capable of being connected to a number of pumps, a number of solenoid valves and a number of meters. This system may be set up such that to dispense one fluid a pump may be turned on from a first control module, that pump being connected to a valve connected to a second control module and even a meter connected with a third module. Of course, the pump, valve and meter may, if desired, all run off of the same module as well. By user programming, the user selects connected sets for each fluid. This architecture minimizes the amount of wiring and other connections as different modules may be closed to different parts of the plumbed section. Provision is made for security on the operator pendants and outputting of data for billing and record keeping.

6 Claims, 1 Drawing Sheet

MULTIPLE FLUID DISPENSING SYSTEM

This applications claims benefit of Provisional application Ser. No. 60/009301 filed Dec. 29, 1995.

BACKGROUND OF THE INVENTION

Systems for dispensing a number of fluids in operations such as vehicle service and the like are well known. At the simplest end, a hand held meter and dispense valve might be used by an individual mechanic to add a predetermined amount of oil to a vehicle.

Typical of previous more sophisticated devices have been sold by the assignee of the invention, Graco Inc., under the designations FLUID COMMANDER™ and ELECTRONIC FLUID COMMANDER™. In such devices a central control module or modules connected to one another control the pump, a solenoid valve adjacent to the dispense point and a meter which measures flow out of the dispense point in order to dispense fluids. The problem with such prior art systems is that such control modules have typically been located centrally as in for instance the main desk of a service facility which requires long runs of multiple cables to the various pumps, solenoid valves and meters for which control is desired.

SUMMARY OF THE INVENTION

It is therefore a object of this invention to provide a multiple fluid dispensing system which is capable of dispensing of substantial numbers of fluids which minimizes the amount of wiring and other plumbing necessary and which may be controlled from one or more positions in the system.

The dispensing system is provided with a plurality of sources of fluid namely tanks of various fluids to be dispensed, such as oil, gear lube and antifreeze. Each of those fluid sources has a pump connected to it and operation of the pump may be controlled via a solenoid which would provide, for instance, pressurized air to the air operated pump. There are also a number of valves associated with each dispense point, that is, associated with a hose reel and manual dispensing valve on that hose.

Lastly there are a number of meters also typically located close to the dispense point which measures the flow of any given fluid through a line. There are also one or more control modules and each control module has a number of terminals to connect to the aforementioned pumps, aforementioned valves and aforementioned meters. If more than one control module is utilized, the control modules communicate with one another through a CAN (Controller Area Network) and are physically connected together by a simple wiring scheme such as twisted pair. There is also at least one control pendant associated with the system for providing operator input.

During an initial setup process, in a typical situation one control module might be located near a hose reel in a particular bay and control the meters and valves associated with the various fluid dispense points on that hose reel while a second control module might be located in the pump room adjacent to the pumps. During setup, an operator or administrator may assign associated connected sets, that is, he or she may decide that a set is comprised of a meter solenoid and a valve solenoid, along with a pump solenoid for a control module.

Thus an operator may enter that he or she wishes to dispense for instance four quarts of a particular fluid through the aforementioned associated set through a pendant located literally anywhere in the system. The control modules talk to each other through the aforementioned network over the simple twisted pair line. These assignments may be remade at any given time as desired. A number of separate dispense operations with the same or different fluids may be carried out at the same time over this networked system.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a schematic view of the instant invention.

DESCRIPTION OF THE PREFERRED EMBODIMENT

Figure 1:
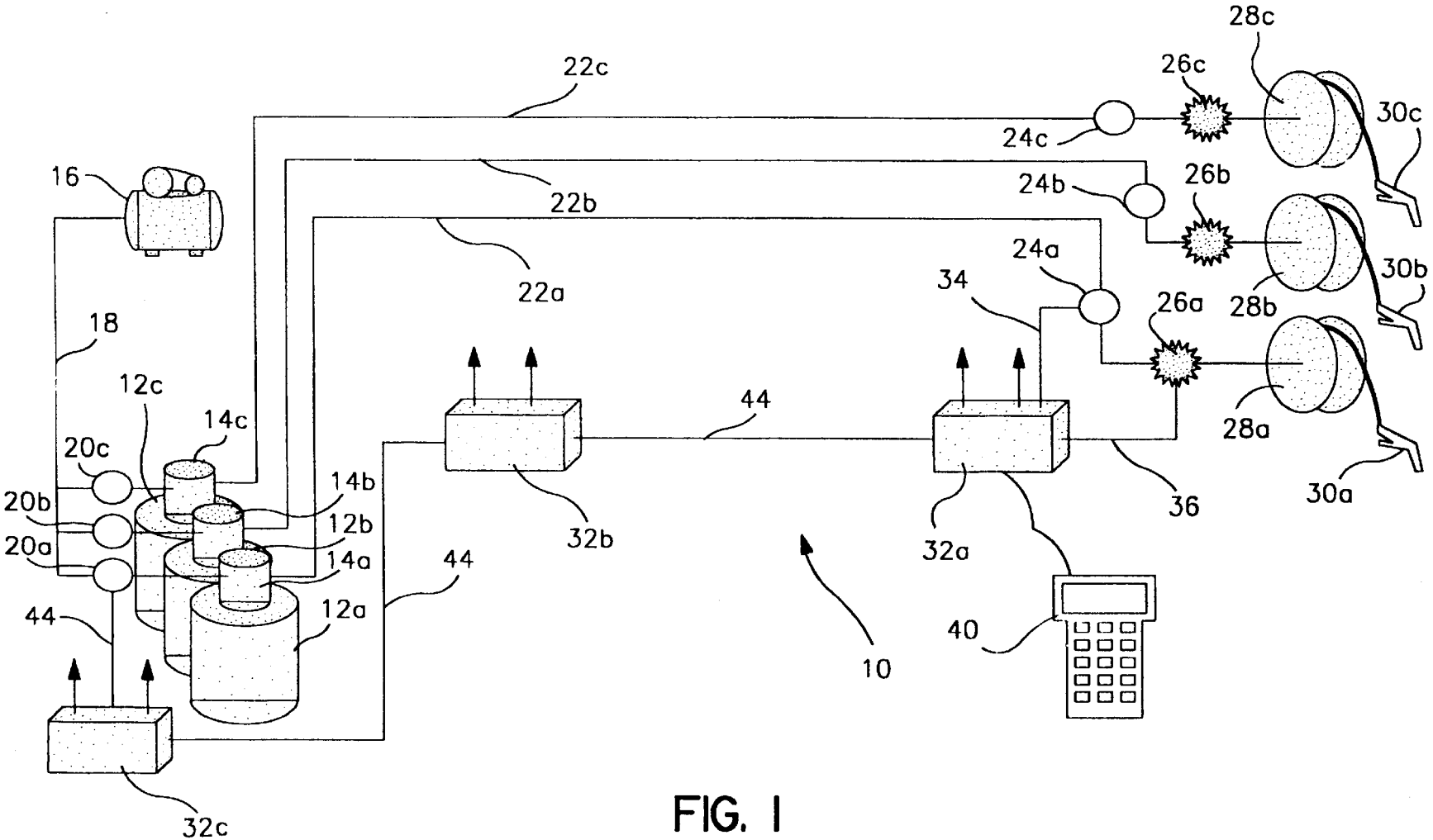

In the instant invention, as shown in FIG. 1, the general plumbing of this system will be described first and the connection of the dispense system thereto will be described thereafter. The invention, generally designated 10, is comprised of a plurality of fluid sources (for sake of simplification three sources are shown here but larger numbers may be used) 12*a,* 12*b* and 12*c,* having connected thereto air operated pumps 14*a,* 14*b* and 14*c,* which are fed by an air compressor 16 via air line 18.

Interposed between air compressor 16 and pumps 14*a,* 14*b* and 14*c* are air solenoid valves 20*a,* 20*b* and 20*c* respectively. The output lines 22*a,* 22*b* and 22*c* from pumps 14*a,* 14*b* and 14*c,* are connected to fluid meters 24*a,* 24*b* and 24*c* respectively. Located on the downstream side of the meters are fluid solenoids 26*a,* 26*b* and 26*c* respectively. The output of the meters is connected to hose reels 28*a,* 28*b* and 28*c* which terminate at dispense nozzles 30*a,* 30*b* and 30*c* respectively.

A plurality of control modules here numbered 32*a,* 32*b* and 32*c,* are connected together via a twisted pair wiring 44. Control modules 32*a,* 32*b* and 32*c* are identical with the exception that one module in the system must be a master module having nonvolatile memory. While three control modules are shown, a larger or smaller number may be used as long as one module is a master module.

For purposes of the illustration, all modules will be treated identically. Each module has a plurality of solenoid ports 36 to control fluid solenoids such as 26*a,* a plurality of meter ports 34 to receive signals from a fluid meter such as 24*a* and a plurality of air solenoid ports 44 which may be used to control an air solenoid such as 20*a* for operation of a pump. While solenoid ports 36 and meter ports 34 are numbered separately, they may be used interchangeably as they are functionally equivalent. Each module 32 is capable of having plugged into it a control pendant 40 which is used to program the system and also to order dispensing of fluids. More than one control pendant per system may be utilized if desired up to and including the total number of modules 32.

Ideally in the typical installation, at least one module such as control module 32*a* in FIG. 1 would be located close to an adjacent hose reel bank containing the hose reels 28*a,* 28*b* and 28*c* and would have fluid solenoid port 34 connected to each fluid solenoid 24. Similarly, each fluid meter 26 would be connected to a fluid meter port 36.

Also in a preferred and conventional installation, the pumps 14 and the fluid sources 12 would be located in an area remote from where the dispensing would take place and thus another control module 32*c* would be located adjacent thereto and one air solenoid port 44 would be connected to an air solenoid 20*a*. While only one of each port is shown in FIG. 1, it is to be appreciated that there are a number of such ports for instance in the drawing, control module 32*a* would have three ports 34 each of which would be connected to one of the fluid solenoids 24*a*, 24*b* and 24*c* respectively. A similar arrangement would be used with the same control module 32*a* for fluid meters 26*a*, 26*b* and 26*c* respectively.

In a small system where all the parts were located adjacent to one another, one control module could be used for all functions as each control module is interchangeable.

During the setup the operator programs associated sets such that when for instance an operator wants to dispense the fluid from source 12*a* out of dispense valve 30*a*, he programs together a set which when activated turns on air solenoid 20*a* at the same time as fluid solenoid 24*a* and meter 26*a*. This independence and ability to assign sets independent of their location as compared to the hardware to which they are connected gives a great amount of flexibility to the operator and installer of such systems and greatly reduces the amount of wiring and piping required for installation.

This allows the use of multiple pendants as control points—as many as one per control module. Operator security may be provided by requiring operator signon with passwords and the like at a pendant in order to operate it. The system may also be used to output data to a printer for billing purposes or to a computer database for billing or maintenance records.

It is contemplated that various changes and modifications may be made to the dispensing system without departing from the spirit and scope of the invention as defined by the following claims.

What is claimed is:

1. A system for dispensing a plurality of fluids comprising a plurality of fluid sources;

a plurality of pump means, each of said pump means being connected to one said fluid source;

a plurality of valves, each said valve being connected to one of said pump means;

a plurality of meters, each said meter being connected to one of said valves;

a plurality of dispense points, each said dispense point being connected to one of said meters;

a plurality of control modules, each said control module comprising a plurality of meter ports and a plurality of valve ports, each said pump means being connected to any of said valve ports on any of said modules, each said valve being connected to any of said valve ports on any of said modules and each said meter being connected to any of said meter ports on any of said modules; and means for operator assignment of associated connected sets, each said set comprising the components of one of said pumps, one of said valves and one of said meters.

2. The dispensing system of claim 1 wherein each said associated connected set may be formed by at least a plurality of said components being connected to different control modules from one another.

3. The dispensing system of claim 2 wherein said control modules comprise:

a master control module; and at least one regular control module, said control modules being connected.

4. The dispensing system of claim 3 further comprising at least one control pendant connected to one of said control modules for controlling dispensing from any part of said system.

5. The dispensing system of claim 4 wherein said means for operator assignment is carried out substantially exclusively from a said single point.

6. The dispensing system of claim 5 wherein said single point is said control pendant.

* * * * *